United States Patent [19]

Dobson et al.

[11] Patent Number: 4,949,483

[45] Date of Patent: Aug. 21, 1990

[54] ADJUSTABLE THICKNESS DISPLAY FRAME

[75] Inventors: William R. Dobson, 1673 Remington Rd., Atlanta, Ga. 30341; Robert L. Browning, Atlanta, Ga.

[73] Assignee: William R. Dobson, Atlanta, Ga.

[21] Appl. No.: 270,838

[22] Filed: Nov. 14, 1988

[51] Int. Cl.[5] ..... A47G 1/06; G09F 1/12

[52] U.S. Cl. ..... 40/155; 40/152

[58] Field of Search ..... 40/152, 152.1, 154, 40/159.2, 642, 156, 155

[56] References Cited

U.S. PATENT DOCUMENTS

| | | | |
|---|---|---|---|
| 1,104,219 | 7/1914 | Polverino | 40/152 |
| 1,463,150 | 7/1923 | Carlsen | 40/152 |
| 2,190,557 | 2/1940 | Connell | 40/152 |
| 2,833,071 | 5/1958 | Glass | 40/154 |
| 3,150,457 | 9/1964 | Thieme | 40/152 |
| 3,203,127 | 8/1965 | Pettersson | 40/152 |
| 3,371,439 | 3/1968 | Smith et al. | 40/152 |
| 3,408,759 | 11/1968 | Rotheraine et al. | 40/152 |
| 3,807,071 | 4/1974 | Candor | 40/152 |
| 3,808,722 | 5/1974 | Byers et al. | 40/152 |
| 4,041,630 | 8/1977 | Holbrook | 40/152.1 |
| 4,314,417 | 2/1982 | Cain | 40/152 |
| 4,432,152 | 2/1984 | Daenen | 40/155 |
| 4,496,127 | 1/1985 | Nelson | 40/152.1 |
| 4,583,309 | 4/1986 | Kane et al. | 40/152 |
| 4,736,538 | 4/1988 | Pierce et al. | 40/158.1 |

*Primary Examiner*—Gene Mancene
*Assistant Examiner*—Michael Lynch
*Attorney, Agent, or Firm*—Jones, Askew & Lunsford

[57] ABSTRACT

A display frame for holding a magazine or a similar article to display the cover. The frame has a front and rear piece, the rear having a back and walls while the front has a bezel and walls. The walls telescope together and ratchets and pawls hold the set position. Removable tabs in the frame can be broken out or retained to position the magazine within the frame for the desired aesthetic appearance.

12 Claims, 1 Drawing Sheet

ADJUSTABLE THICKNESS DISPLAY FRAME

FIELD OF INVENTION

This invention relates generally to display frames, and is more particularly concerned with a display frame adjustable in thickness for receiving a range of objects.

BACKGROUND OF THE INVENTION

It is well known in the art to utilize a frame for displaying pictures and other articles of aesthetic value, and numerous mechanical arrangements have been used to display particular kinds of articles. The mounting of thin, flat objects is quite easy, and the prior art is replete with frames having various devices for securing a flat object against a glass. Bulkier or thicker objects present problems in display, and frames are often designed for use with a specific object in order to accommodate the peculiarities of such objects. For example, one may want to frame an entire magazine so as to display only the cover of that magazine. While the cover itself could be separated from the magazine and mounted in a conventional picture frame, that action would mutilate the magazine and destroy the aesthetic appeal and tangible value of the magazine. Custom framing to accommodate relatively thick or outsize objects is expensive and time-consuming.

One frame for outsize objects is shown in U.S. Pat. No. 4,041,630 issued Aug. 16, 1977. That patent discloses a rectangular member having a groove of sufficient width to receive a particular object to be framed, one of the sides of the rectangle defining a slot for receiving the object. While such frame construction is practical for some objects, such a s the album covers contemplated by the disclosure, it will be understood that the frame must be designed of a particular size of object, and very little variation in the object will render the frame unusable.

Another prior-art frame is shown in U.S. Pat. No. 3,807,071 issued April 30, 1974. This device is designed to recieve a multiple page document for display, but the document must have holes to receive screws which hold the document within the frame. The frame is arranged to allow viewing of all the multiple pages of the document rather than just the front of the document.

The prior art does not disclose a frame that is adjustable for mounting an object of substantial thickness, such as a magazine, allowing for the usual variation in the horizontal and vertical sizes of the magazines. Many magazines or the like are very special in some way, and one may wish to display such an issue, or the cover of such an issue, without mutilating or destroying the magazine.

SUMMARY OF THE INVENTION

Stated in general terms, the present display frame includes a pair of frame members which fit together to form the front and back of the frame. A magazine or other article fits between the frame members, and an adjustable latch allows interconnecting the frame members with variable spacing between the frame members so as to accommodate articles throughout a range of thicknesses. The display frame can vary the lateral position of the article relative to the frame opening for viewing the article, thereby accommodating variations in width and height of articles being framed.

Stated with somewhat greater detail, the present invention provides a display frame including a front member and a rear member, the two members being sized to telescope and thereby allow variation in the thickness of the object received in the frame. An adjustable latch holds the frame at the selected thickness. Positioning tabs extend radially inwardly from the periphery of a frame member, and selectively support the article in spaced relation to the periphery. Two or more such tabs preferably are formed on at least one peripheral edge of the frame, with some or all of the tabs being removable if necessary to accommodate an article of greater overall dimension within the frame. The tabs thus allow placing objects over a range of signs within the frame for display of the object as desired.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE PREFERRED EMBODIMENT

Figure 1:
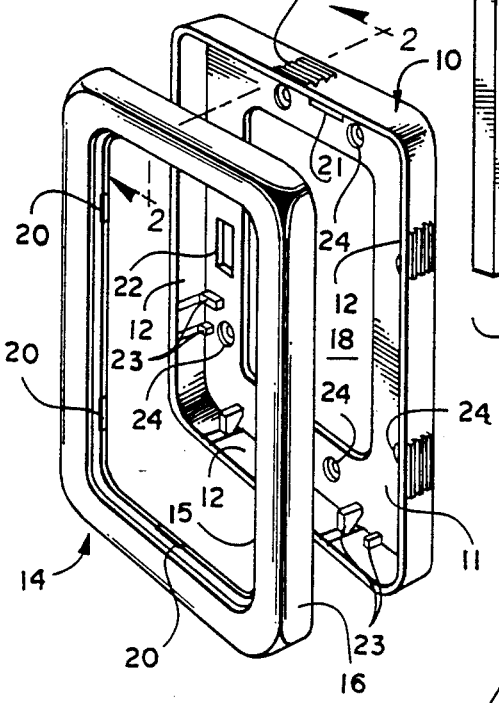
FIG. 1 is an exploded pictorial view showing a frame made in accordance with a preferred embodiment of the present invention.

Referring now more particularly to the drawings, and to that embodiment of the invention here presented by way of illustration, the frame shown in FIG. 1 comprises a rear frame member 10 which includes a back plate 11 and side walls 12, and a front frame member 14 which includes a bezel 15 and side walls 16. It will be understood that the side walls 16 of the front frame member 14 are sized to fit snugly over, and telescope within, the side walls 12 of the rear frame member 10, and to receive an object such as a magazine or the like therebetween.

Those skilled in the art will realize that the frame of the present invention can be utilized for holding and displaying a large variety of objects, including record albums, plaques, books and magazines, as well as pictures mounted on relatively thick material. For simplicity, the following description discusses the frame as used for displaying magazines, and it will be understood that the description is by way of illustration only and is not intended to limit the scope of the invention.

Looking now at the rear frame member 10 in more detail, it will be seen that the back plate 11 defines an opening 18 generally centrally thereof. Provision of the opening 18 reduces the amount of material required, and of course reduces the weight of the frame as a whole. Nevertheless, if the frame is to be used with a particularly flimsy object or material, the back plate 11 can be fully coextensive with the object being framed and the back plate may be solid or of a reticulated material.

The side walls 12 at the periphery of the rear frame member 10 extend forwardly, generally perpendicularly to the back plate 11. On the outside surface of the side wall 12 is the latching element indicated at 19. It will be understood that there is a cooperating latching element 20 on the front frame member 14, and the construction and operation of these cooperating elements are discussed in more detail hereinafter.

In using the frame of the present invention it is contemplated that the magazine (not shown) or other article will be received against the back plate 11 of the rear frame member 10. The front frame member 14 is then telescopically placed over the rear frame member 10 to sandwich the magazine in place between the front and rear frame members. It is preferable that the magazine be appropriately positioned within the rear frame member 12.

Those skilled in the art will realize that a magazine may be generally letter-size format, letter-size being considered 8½ inches by 11 inches. Magazines of the letter-size format may not be precisely 8½ inches by 11 inches, but may vary somewhat from these dimensions. As a result, a frame made for letter-size magazines must allow for some variation in dimenesions. Further, it will be recognized that, when a magazine is to be displayed, it may be desirable to raise or lower, or otherwise shift, the magazine in the frame to expose the precise portion of the magazine desired to achieve the preferred aesthetic effect. For these purposes, the frame of the present invention includes the positioning tabs indicated at 23.

In FIG. 1 it will be noted that there is a plurality of positioning tabs 23 on the lowermost wall 12 and on the wall at the left of the drawing. It is contemplated that such positioning tabs preferably are on all four side walls 12 of the rear frame member 10, though any particular positioning devices desired can be utilized, and any number of such tabs or alternative positioning devices can be provided to allow the desired range of lateral positions relative to the opening 18 of the frame.

The positioning tabs 23 are discussed in more detail hereinafter, but it should be understood here that the positioning tabs are intended for engaging the edges of a magazine or other article being framed, in order to hold the magazine in a predetermined position within the frame. Tabs 23 of different lengths are provided, and the undesired tabs are easily broken away to position the magazine appropriately.

The preferred embodiment of the invention is molded of a plastic material or the like, and it is contemplated that a hanging element is integrally molded with the rear frame member 10. In FIG. 1, two such hanging elements are generally indicated at 21 and 22, the hanging element 21 being arranged to hang the frame when the magazine is in a vertical format, and the hanging element 22 being arranged for use when the magazine is in a horizontal format. Further, the rear frame member 10 includes a plurality of holes 24, the holes 24 preferably being arranged in pairs so that conventional picture hanging wire can be attached to the frame member 10 if desired.

Figure 2:
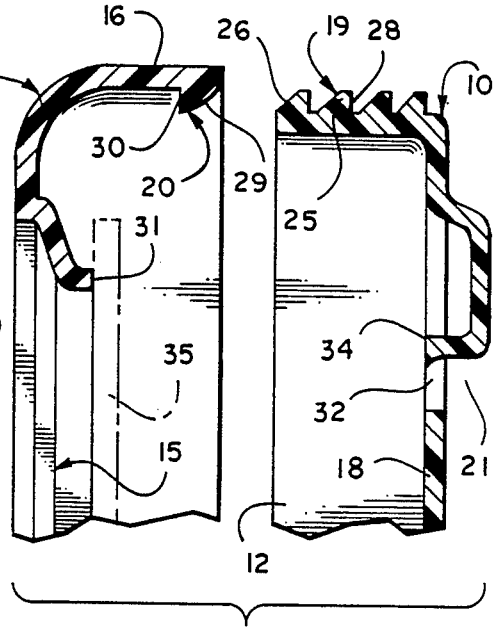
FIG. 2 is an enlarged fragmentary cross-sectional view taken along the line 2—2 in FIG. 1.

With the above description in mind, it will be understood that the front frame member 14 has the side walls 16 sized to snugly fit over the side walls 12 of the rear frame member 10. A plurality of latching elements 19 and 20 cooperate to hold the front and rear frame members 14 and 10 in the desired telescoped position while the positioning means 23 position the magazine vertically and horizontally within the frame as desired. FIG. 2 shows the latching elements 19 and 20 in more detail, and it will be seen that the latching element 19 includes a plurality of teeth 25 having a forward sloped surface 26 and a rear locking surface 28. Thus, the latching element 19 comprises a ratchet that allows the front frame member 14 to be urged into place over the rear frame member 10, the ratchet 19 allowing easy motion for installing the front frame member 14 while restraining motion in the opposite direction.

The latching element 20 on the front frame member 14 is designed as a pawl to cooperate with the ratchet 19. The pawl 20 has a rear sloped surface 29 and a forward locking surface 30. It will therefore be understood that as the front frame member 14 is urged into place over the rear frame member 10, the sloped surface 29 of the pawl 20 engages the sloped surfaces 26 of one or more teeth 25, and the walls 12 and 16 are urged apart sufficiently to allow the pawl 20 to move rearwardly with respect to the ratchet 19. When the pawl 20 snaps between two adjacent teeth 25, the locking surfaces 28 and 30 will be engaged so the front frame member 14 cannot be unintentionally removed from the rear frame member 10. The two frame members will therefore be held securely against inadvertent motion.

FIG. 2 also shows the bezel 15 in more detail. While the bezel 15 can be formed with any desired configuration to meet aesthetic goals, the innermost end of the bezel 15 should include a holding rim 31. The holding rim 31 is simply an edge that will engage the magazine within the frame to hold the magazine securely. While the edge 31 is here shown as a straight edge, it will be understood that the edge 31 may be provided with a bead, or a wider flat surface or the like.

It will be noted that the hanging element 21 is also shown in FIG. 2 of the drawings. Such hanging elements are well known in the art, but it should be noted that the hanging element 21 includes an opening 32 that extends downwardly beyond the hook-engaging surface 34 of the hanging element. When the frame of the present invention is molded of plastic or the like, this particular arrangement will show molding the hanging element 21 easily in one step without a subsequent finishing operation.

In the foregoing description, it has been mentioned that the holding rim 31 bears directly against the magazine being displayed in the frame of the present invention. In FIG. 2 a viewing glass is shown in phantom at 35, but it will be clear to those skilled in the art that any generally transprent material can be placed over the magazine as the magazine is put into the frame of the present invention. Thus, the viewing glass 35 may include a conventional picture frame glass, or a similar sheet of transparent plastic material, and including very thin transparent materials such as sheet materials of one mil or less.

Figure 3:
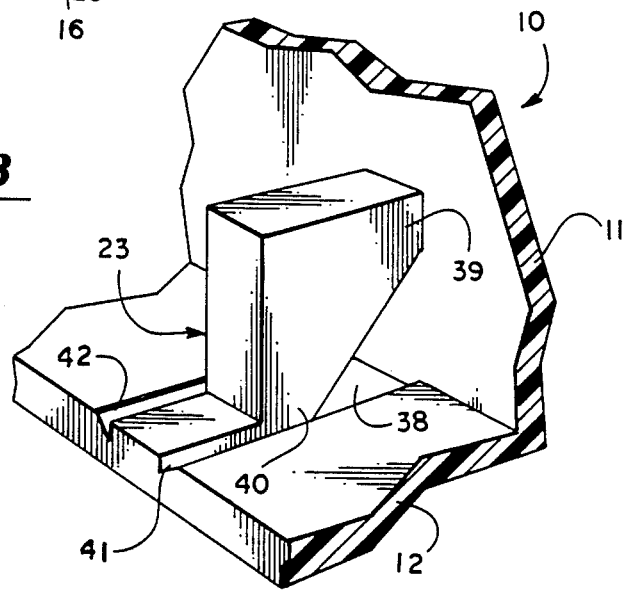
FIG. 3 is an enlarged fragmentary pictorial view showing one positioning tab used in the disclosed embodiment of the present invention.

Attention is now directed to FIG. 3 of the drawings which shows one of the positioning tabs 23. It will be seen that the side wall 12 is shown fragmentarily, with a fragmentary portion of the back plate 11. A plurality of the tabs 23 preferably is clustered at one or more locations on each side wall 12. The lengths of the tabs 23 of each cluster are staggered as seen in FIG. 1, so that the free end of each tab in a cluster extends inwardly a different distance from the side wall 12. The free ends of the tabs 23 support the sides of a magazine or the like in the frame, and individual tabs can be removed as needed for properly positioning the magazine in relation to the opening defined by the bezel 15 of the frame. The positioning tabs are integrally molded with the rear frame member 10. Although each tab 23 might be simply a block molded with or placed into the rear frame member 10, the arrangement here shown allows the desirable function of the positioning tab 23 and further allows easy removal of the tabs if desired. Also, the positioning tabs 23 as shown in FIG. 3 is arranged for easy molding with the rear frame member 10.

First, to reduce the size of the areas to be broken when removing a tab 23, an opening 38 from the rear of the rear frame member 10 preferably is formed by a mold projection. By providing the opening 38, there is only a short attachment of the tab 23 to the rear wall 11, as indicated at 39. Also, a similar area 40 provides attachment of the tab 23 to the side wall 12.

To assist further in allowing easy removal of the tab 23, there is a pair of grooves 41 and 42 in the side wall 12 immediately adjacent to the tab. The presence of the grooves 41 and 42 reduces the lateral strength of the tab 23 at the side wall 12, again making it easier to remove the tab.

Those skilled in the art will realize that all of the corners where the tab 23 meets the back wall 11 and the side wall 12 preferably are formed as square corners rather than being radiused, and that this arrangement renders the material more easily fracturable.

From the foregoing description, it will be readily understood that the frame of the present invention is easily moldable, as by injection molding, from any desired plastic material. Very inextensive frames may be made from polystyrene or the like while more expensive and better quality frames can be made from nylon, acrylic and acrylic copolymers, polycarbonates and other relatively durable materials. The frames may be made in almost any size including a size small enough to hold the containers for compact discs or small plaques, and can be large enough to receive magazines, newspapers, posters or the like.

In framing an object with the frame of the present invention, the object is placed in the rear frame member 10, appropriate positioning tabs 23 being removed as desired to achieve the preferred positioning. The front frame member 14 can then simply be urged over the rear frame member 10, and the pawls 20 engage the ratchets 19 to secure the front frame member 14 in place. If one wishes to remove the front frame member 14 from the rear frame member 10, it will be understood that a thin tool can be slipped between the walls 16 and 12, separating the ratchet 19 and pawl 20 enough to allow removal of the front frame member.

It will of course be understood by those skilled in the art that the particular embodiment of the invention here presented is by way of illustration only, and is meant to be in no way restrictive. Therefore, numerous changes and modifications may be made, and the full use of equivalents resorted to, without departing from the spirit or scope of the invention as set forth in the appended claims.

What is claimed is:

1. A display frame for framing an article so as to display one surface of the article, comprising:

a first frame member for receiving the article;

a second frame member for holding the article within the first frame member;

one of the frame members having an opening therein for exposing the one surface of the article;

one of the frame members having a peripheral wall and selectively adjustable means for laterally defining the position of the article within the frame member at a plurality of spaced distances apart from the peripheral wall, so as to centrally position articles of several different lateral dimensions relative to the opening;

the positioning means comprising a plurality of members associated with and extending radially inwardly from the peripheral wall;

a first one of said plurality of members having a first radial spacing from the peripheral wall and a second one of said plurality of members having a second radial spacing from the peripheral wall, so that the first and second members support the article in selectively different spaced relations to the peripheral wall; and at least one of the first and second members including means for aiding selective removal of said one member from the peripheral wall so as to selectively accommodate an article of greater dimension than the spacing provided by the one member.

2. The display frame as in claim 1, wherein the positioning means comprise tabs extending radially inwardly from the peripheral wall to support the article in spaced relation to the peripheral wall.

3. The display frame as in claim 1, wherein said means for aiding selective removability of at least one member comprises a region of predetermined structure weakness operatively associated with said member so as to render that member more easily detachable from the peripheral wall of the one frame member.

4. A display frame for framing an article so as to display one surface of the article comprising:

a first frame member for receiving the article;

a second frame member for holding the article within the first frame member;

one of the frame members having an opening therein for exposing the one surface of the article;

one of the frame members having a peripheral wall and selectively adjustable means for laterally defining the position of the article within the frame member at a plurality of spaced distances apart from the peripheral wall, so as to centrally position articles of several different lateral dimensions relative to the opening;

the peripheral wall comprises plural wall segments defining a region for receiving the article within the display frame;

the positioning means comprises a plurality of tabs affixed to at least one of the wall segments and extending inwardly therefrom, each tab supporting the article at a certain spaced relation to the corresponding wall segment so as to selectively position the article relative to the opening in the frame member; and at least one of the tabs being selectively removable from the corresponding wall segment so as to accommodate the article.

5. The display frame as in claim 4, wherein:

the removable tabs are integrally formed with the corresponding wall segment; and further comprising means defining a region of predetermined structural weakness operatively associated with the removable tabs and selectively fracturable for removal of the tabs from said wall segment.

6. A display frame for framing an article to display one surface of the article, the frame comprising:

a rear frame member for receiving the article;

a front frame member for holding the article within said rear frame member;

said front frame member defining an opening therein for exposing said one surface of the article;

latching means for selectively latching said front frame member with respect to said rear frame member, the rear frame member including a back plate;

walls extending forwardly from said back plate;

said walls carrying said latching means;

said front frame member including a bezel surrounding said opening and walls extending rearwardly from said bezel;

said walls of said front frame member being sized to telescope over said walls of said rear frame member;

said walls of said front frame member carrying said latching means;

said latching means on said rear frame member including a ratchet;

said latching means on said front frame member including a pawl located for engagement with said ratchet; and said pawl engaging said ratchet when said front frame member telescopes over said rear frame member, allowing said front frame member to move towards said rear frame member while preventing said front frame member from moving relatively rearward.

7. A display frame as claimed in claim 6:

said rear frame member including a back plate;

walls extending forwardly from said back plate; and selectively adjustable positioning means for laterally spacing said article from said forwardly-extending walls for centrally locating articles of several different lateral dimensions within said rear frame member.

8. A display frame as claimed in claim 7, said positioning means comprising at least one tab detachably fixed to said forwardly-extending walls.

9. A display frame as claimed in claim 8, and further including a plurality of tabs fixed to said forwardly-extending walls, said plurality of tabs including a first group of tabs having a first length and a second group of tabs having a second length, said second tabs including means selectively fracturable for removal from said rear frame member.

10. A display frame as claimed in claim 9, said forwardly-extending walls carrying said latching means.

11. A display frame as claimed in claim 10;

said front frame member including a bezel surrounding said opening, and walls extending forwardly from said bezel;

said walls of said front frame member being sized to telescope over said walls of said rear frame member; and said walls of said front frame member carrying said latching means.

12. A display frame as claimed in claim 10:

said latching means on said rear frame member including a ratchet;

said latching means on said front frame member including a pawl located for engagement with said ratchet; and the arrangement being such that said pawl engages said ratchet when said front frame member telescopes over said rear frame member, allowing said front frame member to move towards said rear frame member while preventing said front frame member from moving rearward.

* * * * *